US012601529B2

(12) United States Patent
Saunders et al.

(10) Patent No.: US 12,601,529 B2
(45) Date of Patent: Apr. 14, 2026

(54) METHOD TO CHARGE MULTIPLE REFRIGERANTS WITH DESIRED CONCENTRATIONS

(71) Applicant: Copeland LP, Sidney, OH (US)

(72) Inventors: Michael A. Saunders, Sidney, OH (US); Andrew M. Welch, Franklin, OH (US)

(73) Assignee: Copeland LP, Sidney, OH (US)

( * ) Notice: Subject to any disclaimer, the term of this patent is extended or adjusted under 35 U.S.C. 154(b) by 173 days.

(21) Appl. No.: 18/382,464

(22) Filed: Oct. 20, 2023

(65) Prior Publication Data

US 2025/0129980 A1 Apr. 24, 2025

(51) Int. Cl.

*F25B 45/00* (2006.01)
*F25B 41/20* (2021.01)
*F25B 41/42* (2021.01)

(52) U.S. Cl.

CPC ..... *F25B 45/00* (2013.01); *F25B 41/20* (2021.01); *F25B 41/42* (2021.01); *F25B 2345/001* (2013.01); *F25B 2345/003* (2013.01); *F25B 2345/004* (2013.01); *F25B 2345/006* (2013.01)

(58) Field of Classification Search

CPC ..... F25B 2400/121; F25B 9/006; F25B 2345/006; F25B 2345/004; F25B 2345/003; F25B 2345/001; F25B 45/00

See application file for complete search history.

(56) References Cited

U.S. PATENT DOCUMENTS

| | | | |
|---|---|---|---|
| 4,363,222 | A | 12/1982 | Cain |
| 5,317,903 | A | 6/1994 | McClelland et al. |
| 6,209,338 | B1 | 4/2001 | Thatcher, Jr. |
| 7,124,598 | B2 | 10/2006 | Quest et al. |
| 7,310,956 | B2 | 12/2007 | Meldahl et al. |
| 7,310,964 | B2 | 12/2007 | Govekar |
| 7,690,209 | B2 | 4/2010 | Matsuoka et al. |

(Continued)

FOREIGN PATENT DOCUMENTS

| | | | |
|---|---|---|---|
| JP | H08136090 A | * | 5/1996 |
| KR | 20090065010 A | | 6/2009 |
| KR | 101878771 B1 | | 7/2018 |

OTHER PUBLICATIONS

European Search Report for European Application No. 24207273.4 dated Mar. 4, 2025.

*Primary Examiner* — Ana M Vazquez
(74) *Attorney, Agent, or Firm* — Harness, Dickey & Pierce, P.L.C.

(57) ABSTRACT

A charging device includes: a first inlet configured to receive a first refrigerant in vapor form; a second inlet configured to receive the first refrigerant in liquid form; a third inlet configured to receive a second refrigerant in liquid form, where the second refrigerant is a different type of refrigerant than the first refrigerant; an outlet configured to output the first and second refrigerants to a refrigeration system; a first valve fluidly connected between the first inlet and the outlet; a second valve fluidly connected between the second inlet and the outlet; a third valve fluidly connected between the third inlet and the outlet; and a control module configured to selectively open the first, second, and third valves and charge the refrigeration system with target amounts of the first and second refrigerants, respectively.

17 Claims, 5 Drawing Sheets

(56) References Cited

U.S. PATENT DOCUMENTS

| | | | |
|---|---|---|---|
| 7,762,089 | B2 | 7/2010 | Govekar et al. |
| 7,905,095 | B2 | 3/2011 | Suharno et al. |
| 9,303,907 | B2 | 4/2016 | Kawano et al. |
| 10,502,483 | B2 | 12/2019 | Gushanas et al. |
| 10,774,822 | B2 | 9/2020 | Xiao et al. |
| 2021/0348816 | A1 | 11/2021 | Yamada et al. |

* cited by examiner

METHOD TO CHARGE MULTIPLE REFRIGERANTS WITH DESIRED CONCENTRATIONS

FIELD

The present disclosure relates to refrigeration systems and methods and more particularly to systems and methods for charging refrigeration systems using multiple different refrigerants.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Compressors may be used in a wide variety of industrial, commercial, and residential applications to circulate refrigerant to provide a desired heating or cooling effect. For example, a compressor may be used to provide heating and/or cooling in a refrigeration system, a heat pump system, a heating, ventilation, and air conditioning (HVAC/R) system, or a chiller system. These types of systems can be fixed, such as at a building or residence, or can be mobile, such as in, or as part of a vehicle. Vehicles include land based vehicles (e.g., trucks, cars, trains, etc.), water based vehicles (e.g., boats, sea containers), air based vehicles (e.g., airplanes), and vehicles that operate over a combination of more than one of land, water, and air.

SUMMARY

In a feature, a charging device includes: a first inlet configured to receive a first refrigerant in vapor form; a second inlet configured to receive the first refrigerant in liquid form; a third inlet configured to receive a second refrigerant in liquid form, where the second refrigerant is a different type of refrigerant than the first refrigerant; an outlet configured to output the first and second refrigerants to a refrigeration system; a first valve fluidly connected between the first inlet and the outlet; a second valve fluidly connected between the second inlet and the outlet; a third valve fluidly connected between the third inlet and the outlet; and a control module configured to selectively open the first, second, and third valves and charge the refrigeration system with target amounts of the first and second refrigerants, respectively.

In further features, a pump is fluidly connected between the third valve and the outlet and configured to pump the second refrigerant to the outlet.

In further features, an injector is configured to receive refrigerant output from the pump.

In further features, a fourth valve is fluidly connected between (a) the outlet and (b) the first, second, and third valves.

In further features, the control module is configured to further control the fourth valve.

In further features, a fifth valve is fluidly connected between (a) the fourth valve and (b) the first, second, and third valves.

In further features, the control module is configured to, before opening the second and third valves, open the first valve and output the first refrigerant in vapor form to the refrigeration system.

In further features, the control module is configured to open the first valve and output the first refrigerant in vapor form to the refrigeration system until a pressure of refrigerant within the refrigeration system is greater than a predetermined pressure.

In further features, the predetermined pressure is at least 75 pounds per square inch gauge.

In further features, the control module is configured to, after the pressure of the refrigerant within the refrigeration system is greater than the predetermined pressure, close the first valve and selectively open the second and third valves.

In further features, a pump is fluidly connected between the third valve and the outlet and configured to pump the second refrigerant to the outlet, where the control module is configured to operate the pump when the third valve is open.

In further features, the control module is configured to operate the pump based on a target concentration of the second refrigerant, a predetermined density of the second refrigerant, and a mass flowrate of the first refrigerant.

In further features, the first refrigerant includes carbon dioxide.

In further features, the second refrigerant includes the R1233zd refrigerant.

In a feature, a charging method includes: receiving a first refrigerant in vapor form via a first inlet of a charging device; receiving the first refrigerant in liquid form via a second inlet of a charging device; receiving a second refrigerant in liquid form via a third inlet of a charging device, where the second refrigerant is a different type of refrigerant than the first refrigerant; outputting the first and second refrigerants from an outlet of the charging device to a refrigeration system; and selectively opening first, second, and third valves and charging the refrigeration system with target amounts of the first and second refrigerants, respectively, where: the first valve is fluidly connected between the first inlet and the outlet; the second valve is fluidly connected between the second inlet and the outlet; and the third valve is fluidly connected between the third inlet and the outlet.

In further features, the charging method further includes, by a pump of the charging device fluidly connected between the third valve and the outlet, pumping the second refrigerant to the outlet.

In further features, the charging method further includes selectively opening a fourth valve of the charging device, wherein the fourth valve is fluidly connected between (a) the outlet and (b) the first, second, and third valves.

In further features, the charging method further includes selectively opening a fifth valve of the charging device, wherein the fifth valve is fluidly connected between (a) the fourth valve and (b) the first, second, and third valves.

In further features, selectively opening the first, second and third valves includes, before opening the second and third valves, opening the first valve and outputting the first refrigerant in vapor form to the refrigeration system.

In further features, selectively opening the first, second, and third valves includes, after a pressure of the refrigerant within the refrigeration system is greater than a predetermined pressure, closing the first valve and selectively opening the second and third valves.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
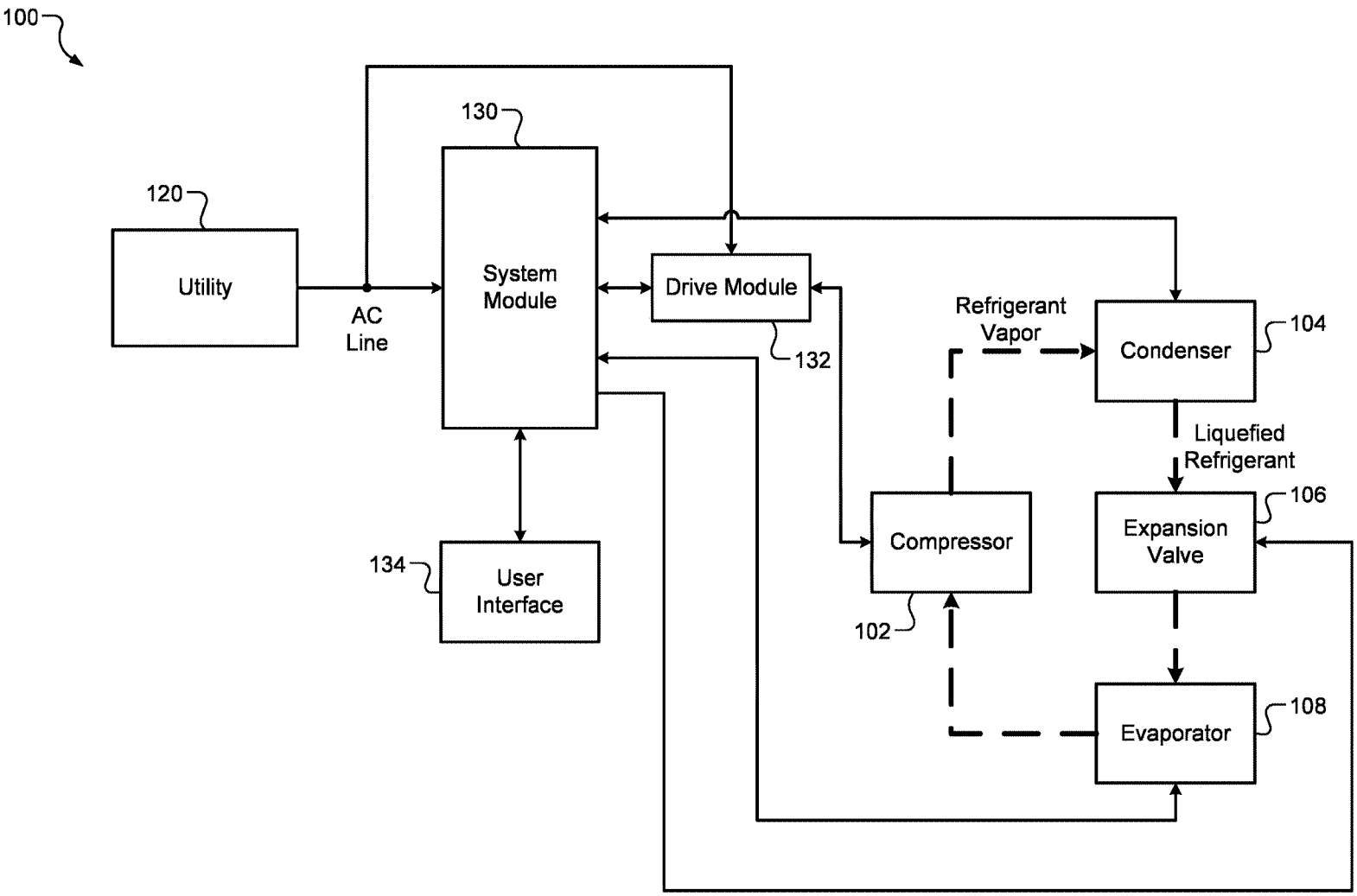
FIG. 1 is a functional block diagram of an exemplary refrigeration system.

Referring now to FIG. 1, a functional block diagram of an example refrigeration system 100 is presented. The refrigeration system 100 may include a compressor 102, a condenser 104, an expansion valve 106, and an evaporator 108. The refrigeration system 100 may include additional and/or alternative components. The present disclosure is applicable to other suitable types of refrigeration systems including, but not limited to, heating, ventilating, and air conditioning (HVAC), heat pump systems, other types of refrigeration systems, chiller systems, and other types of systems that provide cooling.

The compressor 102 receives refrigerant in vapor form and compresses the refrigerant. The compressor 102 provides pressurized refrigerant in vapor form to the condenser 104. The compressor 102 includes an electric motor that drives a pump. For example only, the compressor 102 may include a scroll compressor and/or a reciprocating compressor.

All or a portion of the pressurized refrigerant is converted into liquid form within the condenser 104. The condenser 104 transfers heat away from the refrigerant, thereby cooling the refrigerant. When the refrigerant vapor is cooled to a temperature that is less than a saturation temperature, the refrigerant transforms into a liquid (or liquified) refrigerant. The condenser 104 may include an electric fan that increases the rate of heat transfer away from the refrigerant.

The condenser 104 provides the refrigerant to the evaporator 108 via the expansion valve 106. The expansion valve 106 controls the flow rate at which the refrigerant is supplied to the evaporator 108. The expansion valve 106 may include a thermostatic expansion valve or may be controlled electronically by, for example, a system module 130. A pressure drop caused by the expansion valve 106 may cause a portion of the liquified refrigerant to transform back into the vapor form. In this manner, the evaporator 108 may receive a mixture of refrigerant vapor and liquified refrigerant.

The refrigerant absorbs heat in the evaporator 108. Liquid refrigerant transitions into vapor form when warmed to a temperature that is greater than the saturation temperature of the refrigerant. The evaporator 108 may include an electric fan that increases the heat transfer to the refrigerant.

A utility 120 provides power to the refrigeration system 100. For example only, the utility 120 may provide single-phase alternating current (AC) power at approximately 230 Volts (V) root mean squared (RMS) or at another suitable voltage. In various implementations, the utility 120 may provide three-phase power at approximately 400 Volts RMS or 480 Volts RMS at a line frequency of, for example, 50 or 60 Hz. The utility 120 may provide the AC power to the system module 130 via an AC line. The AC power may also be provided to a drive module 132 via the AC line.

The system module 130 controls the refrigeration system 100. For example only, the system module 130 may control the refrigeration system 100 based on user inputs and/or parameters measured by various pressure sensors (not shown). The sensors may include pressure sensors, temperature sensors, current sensors, voltage sensors, etc. The sensors may also include feedback information from the drive module 132, such as motor currents or torque, over a serial data bus or other suitable data buses.

A user interface 134 provides user inputs to the system module 130. The user interface 134 may additionally or alternatively provide the user inputs to the drive module 132. The user inputs may include, for example, a desired temperature, requests regarding operation of a fan (e.g., the evaporator fan), and/or other suitable inputs. The system module 130 may control operation of the fans of the condenser 104, the evaporator 108, and/or the expansion valve 106.

The drive module 132 may control the compressor 102 based on commands from the system module 130. For example only, the system module 130 may instruct the drive module 132 to operate the compressor motor at a target speed. In various implementations, the drive module 132 may also control the condenser fan. In the present application, the refrigerant within the refrigeration system 100 includes (e.g., a blend of) two or more different refrigerants.

Figure 2A:
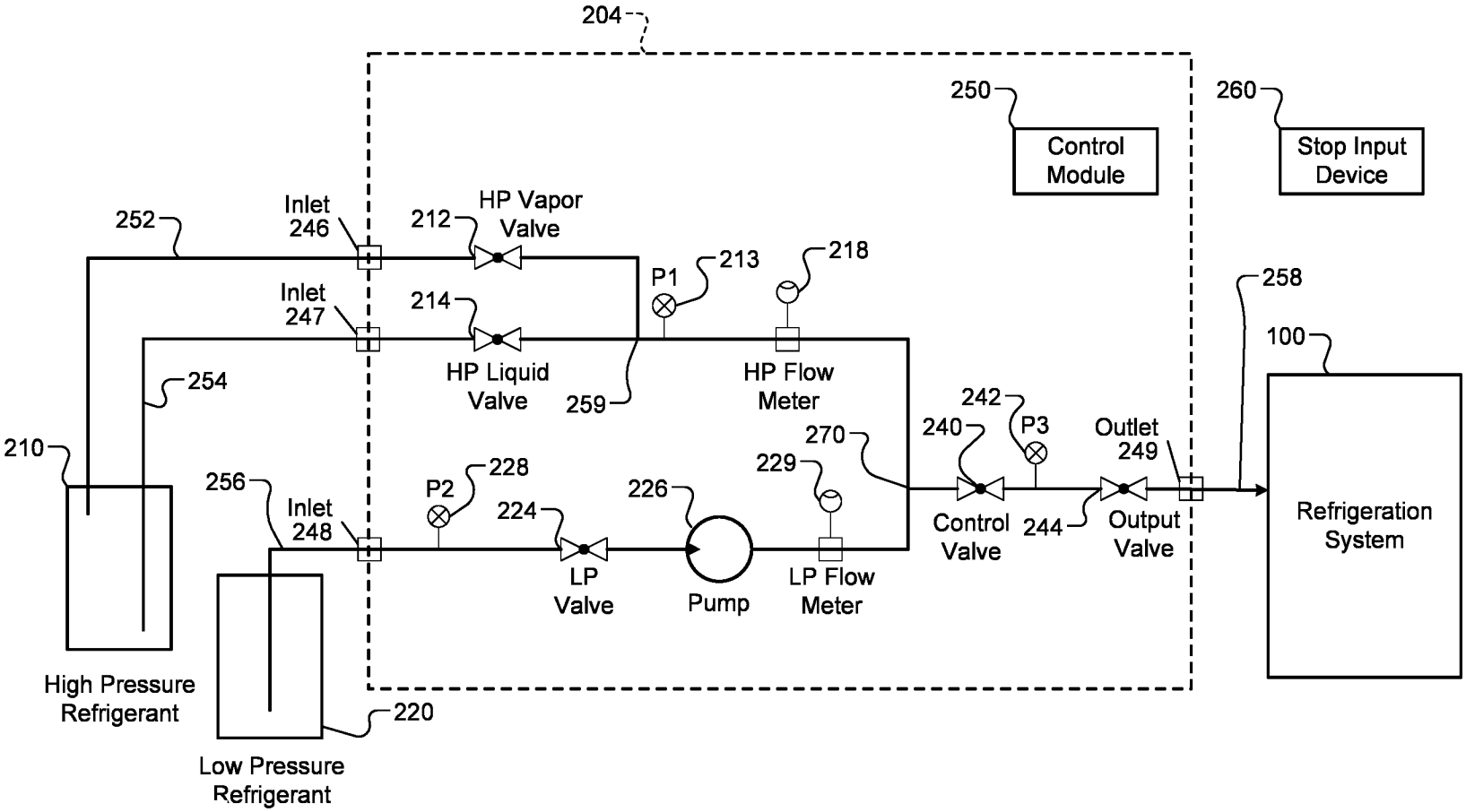
FIGS. 2A and 2B are functional block diagrams of example systems for filling a refrigeration system with multiple different types of refrigerants.
Figure 2B:
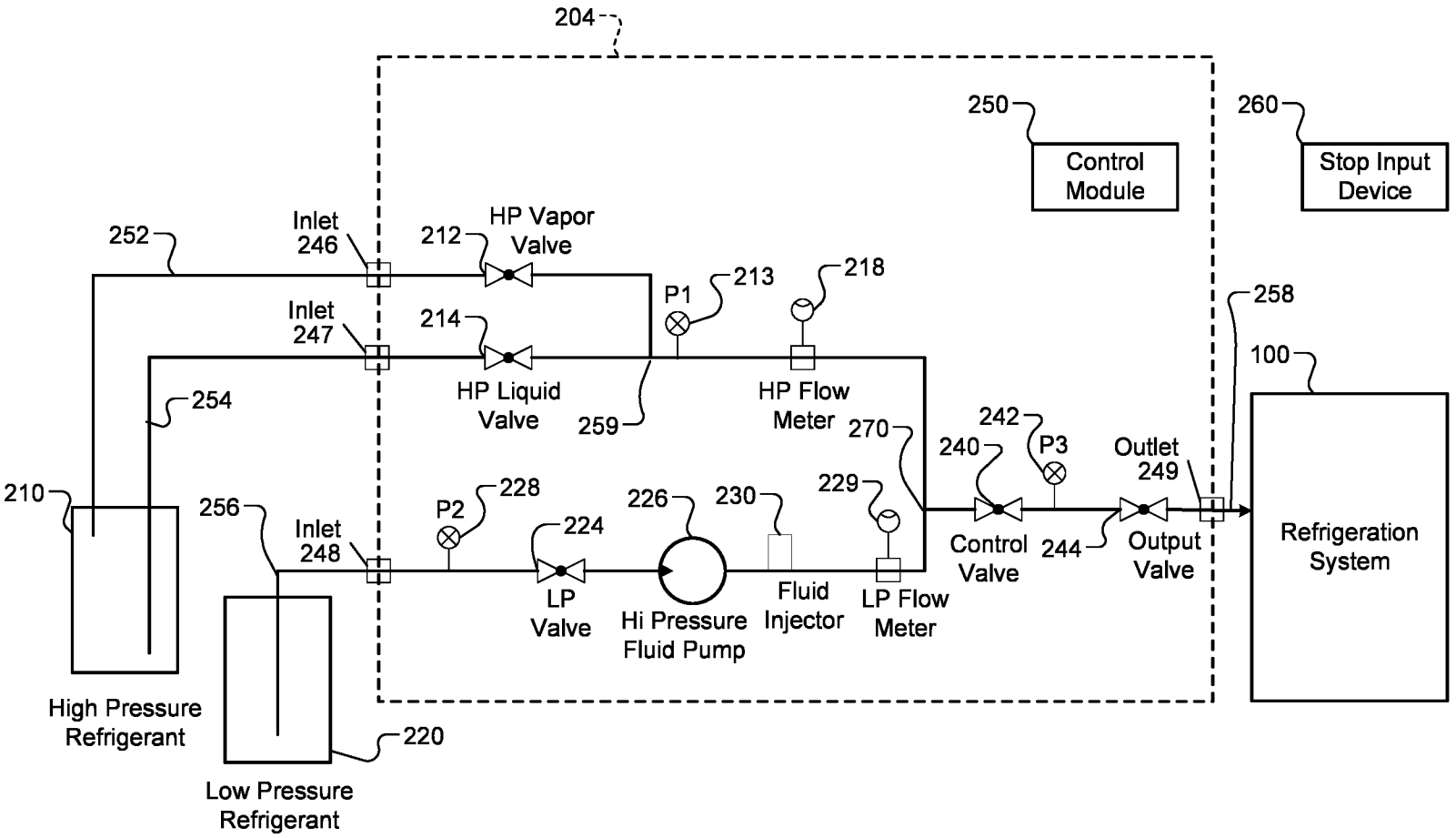

FIGS. 2A and 2B are functional block diagrams of example systems for filling a refrigeration system with multiple different types of refrigerants. Referring now to FIG. 2A, examples of two different types of refrigerants are shown including a high-pressure refrigerant 210 (a first refrigerant) stored in a tank and a low pressure refrigerant 220 (a second refrigerant) stored in a tank.

A charging device 204 includes a high pressure (HP) vapor valve 212 (a first valve), a high pressure (HP) liquid valve 214 (a second valve), and a low pressure (LP) liquid valve 222 (a third valve). The charging device 204 also includes a high pressure (HP) flow meter 218 (e.g., a mass flowrate sensor), a low pressure (LP) flow meter 229 (e.g., a mass flowrate sensor), a plurality of pressure sensors 213, 228, 242, a pump 226, a control valve 240 (a fourth valve), and an output valve 244 (a fifth valve). The charging device 204 also includes first, second, and third inlets 246, 247, 248 and an outlet 249. The charging device 204 is configured to charge the refrigeration system 100 with a first target concentration of the high pressure refrigerant 210 and a second target concentration of the low pressure refrigerant 220. The dashed lines of 204 may denote a housing of the charging device 204.

A vapor conduit 252, such as a tube, pipe, or hose, is connected between the inlet 246 and a vapor outlet of the tank in which the high pressure refrigerant 210 is stored. The charging device 204 receives the high pressure refrigerant 210 in vapor form via the vapor conduit 252. A liquid conduit 254, such as a tube, pipe, or hose, is connected between the inlet 247 and a liquid outlet of the tank in which the high pressure refrigerant 210 is stored. The charging device 204 receives the high pressure refrigerant 210 in liquid form via the liquid conduit 254. A conduit 256, such as a tube, pipe, or hose, is connected between the inlet 248 and an outlet of the tank in which the low pressure refrigerant 220 is stored. The charging device 204 receives the low pressure refrigerant 220, such as in liquid form via the conduit 256. A conduit 258, such as a tube, pipe, or hose, is connected between the outlet 249 and an inlet of the refrigeration system 100. The charging device 204 inputs the high and low pressure refrigerants 210 and 220 to the refrigeration system 100, thereby charging the refrigeration system 100, via the outlet 249, the conduit 258, and the inlet of the refrigeration system 100. The inlets and outlet may be, for example, quick connect inlets/outlets, threaded connectors, or another suitable type of connector to allow connection and disconnection.

The high-pressure refrigerant 210 may be for example carbon dioxide ($CO_2$) or another suitable type of refrigerant. Vapor form of the high pressure refrigerant 210 may be drawn from vertically higher within the tank than where the liquid form of the high pressure refrigerant 210 is drawn. The low-pressure refrigerant 220 may be for example R1233zd refrigerant or another suitable type of refrigerant.

The high pressure (HP) liquid valve 214 receives the high pressure refrigerant in liquid form via the inlet 247. The high pressure vapor valve 212 receives the high pressure refrigerant in vapor form via the inlet 246. When open, the high pressure liquid and vapor valves 214 and 212 output high pressure refrigerant to a node 259.

The valves may be, for example, solenoid valves, throttle valves, or another suitable type of valve.

The low pressure (LP) valve 214 receives the low pressure refrigerant, such as in liquid form, via the inlet 248. The pump 226 pumps low pressure refrigerant through the low pressure liquid valve 224 to a node 270 when the low pressure valve 224 is open. The pump 226 is an electric pump and pumps low pressure refrigerant toward the node 270 when power is applied to the pump 226. The node 259 is fluidly connected with the node 270 such that the high pressure refrigerant 210 can mix with the low pressure refrigerant 220 before being input to the refrigeration system 100. The charging device 204 outputs refrigerant (low and/or high pressure refrigerant) to the refrigeration system 100 when the control valve 240 and the output valve 244 are open.

The pressure sensor 213 measures a pressure of the high pressure refrigerant 210 between the node 259 and the node 270. The pressure sensor 228 measures a pressure of the low pressure refrigerant 220 input to the charging device 204. The pressure sensor 242 measures a pressure of refrigerant between the node 270 and the output valve 244, such as between the control valve 240 and the output valve 244. The high pressure flow meter 218 measures a flow rate (e.g., mass flow rate) of the high pressure refrigerant 210 to the node 270. The low pressure flow meter 229 measures a flow rate (e.g., mass flow rate) of the low pressure refrigerant 220 to the node.

The control module 250 receives input values from the flow meters and pressure sensors. The control module 250 controls opening of the valves 212, 214, 224, 240, and 244 and operation of the pump 226 (e.g., whether the pump 226 is on or off and speed if on) based on one or more measured parameters and charging the refrigeration system 100 with target concentrations of the low pressure refrigerant 220 and the high pressure refrigerant 210, respectively. In various implementations, the low pressure flowmeter 229 may be omitted as the flow rate and (e.g., a flow rate module of) the control module may determine the flow rate, such as based on the speed of the pump 226 or based on the speed of the pump and the pressure difference between the pressures measured by pressure sensors 228 and 242.

As discussed further below, the control module 250 may first charge the refrigeration system 100 with vapor form of the high pressure refrigerant 210 until the pressure measured by the pressure sensor 242 is greater than a predetermined pressure, such as approximately 100 psig (pounds per square in gauge). The predetermined pressure may be a pressure that is greater than a triple point pressure of the high pressure refrigerant 210. This may help prevent formation solid phase form from the high-pressure refrigerant 210 (e.g., dry ice). Once the pressure is greater than the predetermined pressure, the control module 250 controls valve opening and pump operation to achieve the target concentrations of high and low pressure refrigerant. The control module 250 may stop charging the refrigeration system 100 with refrigerant (e.g., close all of the valves and shut off the pump 226) in response to input from a stop input device 260. The stop input device 260 may be, for example, a button or switch. In various implementations, the stop input device 260 may be part of the charging device 204.

Referring to FIG. 2B, the pump 226 may be a high pressure pump and an injector 230 may receive refrigerant output by the pump 226. The control module 250 controls opening of the injector 230 to control low pressure refrigerant input to the refrigeration system 100. In this example, the control module 250 may operate the pump 226 at a predetermined speed. The injector 230 may be, for example, a solenoid injector or another suitable type of injector or valve.

Figure 3:
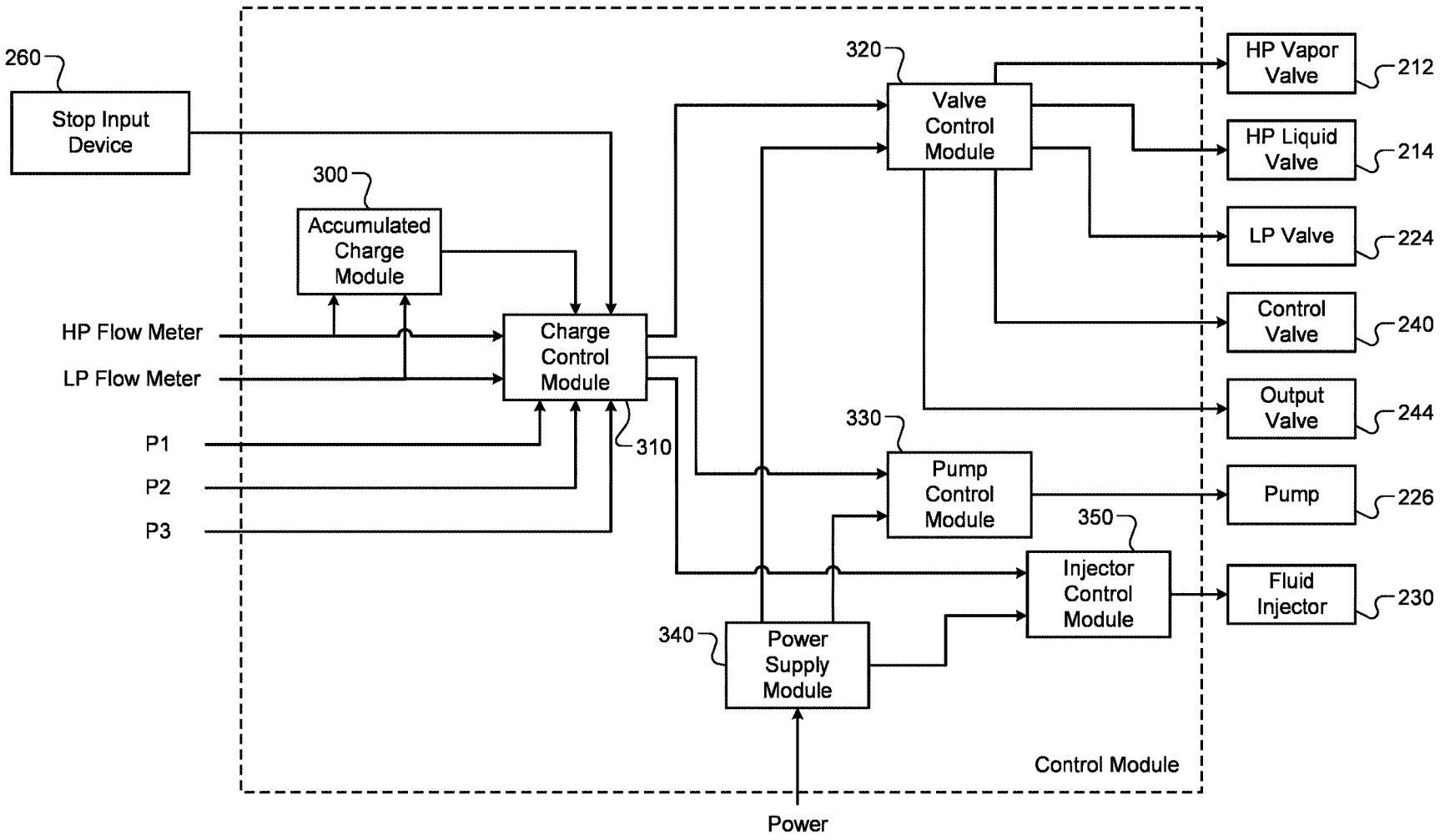
FIG. 3 is a functional block diagram of a control module of a filling device.

Referring now to FIG. 3, a functional block diagram of an example implementation of the control module 250 is presented. A valve control module 320 controls opening and closing of the valves (212, 214, 224, 240, and 244). A pump control module 330 controls whether the pump 226 is on or off and, if on, a speed of the pump 226. An injector control module 350 controls opening and closing of the injector 230.

An accumulated charge module 300 receives the measurements from the HP flow meter 218 and the LP flow meter 229 and calculates a refrigerant charge (e.g., mass) input to the refrigeration system 100 based on the measurements. For example, the accumulated charge module 300 may determine a mass of the high pressure refrigerant 210 input based on summing mathematical integrals of the flow rate measured by the high pressure flow meter 218. Mathematical integrals of a mass flow rate are masses, respectively. Summing the masses (determined using mathematical integrals) yields a present total mass of the high pressure refrigerant 210 input to the refrigeration system 100. The accumulated charge module 300 may determine a mass of the low pressure refrigerant 220 input based on summing mathematical integrals of the flow rate measured by the low pressure flow meter 229. The accumulated charge module 300 may determine the total refrigerant charge input to the refrigeration system based on a sum (addition) of the mass of the low pressure refrigerant 220 input and the mass of the high pressure refrigerant 210 input.

The valve control module 320, the pump control module 330, and the injector control module 350 control the valves, the pump 226, and the injector 230 based on input from a charge control module 310. The charge control module 310 controls the valve control module 320, the pump control module 330, and the injector control module 350 based on inputting target concentrations (or amounts) of the high and low pressure refrigerants 210 and 220, respectively, to the refrigeration system 100.

Figure 4:
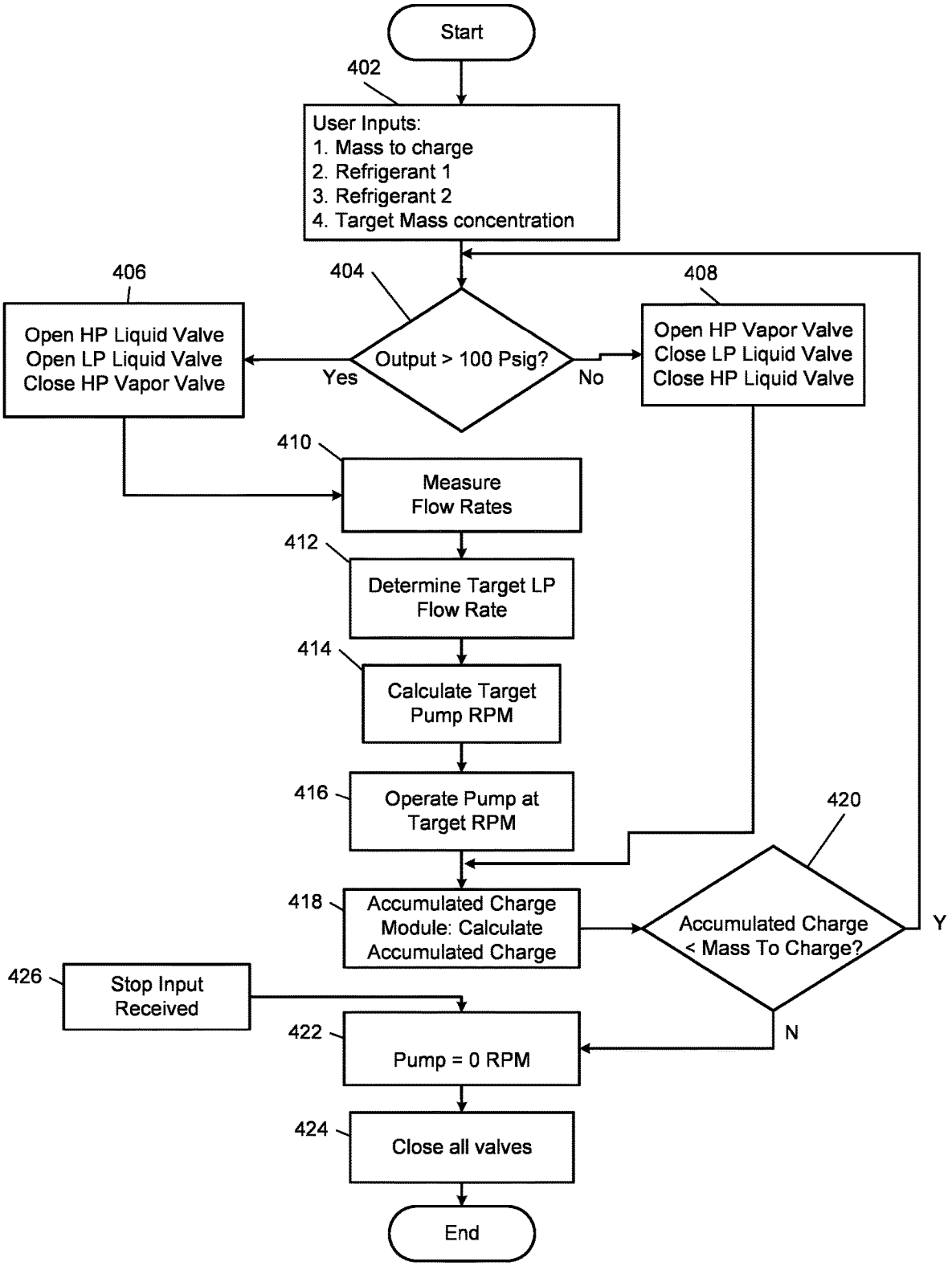
FIG. 4 is a method for charging a refrigeration system multiple refrigerants with desired concentrations.

A power supply module 340 provides electrical power to the valve control module 320, the pump control module 330, and the injector control module 350. The Referring now to FIG. 4, a method for charging a refrigeration systems with target concentrations of multiple different refrigerants, respectively, is provided. Control may begin with 402 where the charge control module 310 receives user input. The user input may include, for example, a total mass to charge the refrigeration system 110 with of both the first and second refrigerants 210 and 220, an identifier of the high pressure refrigerant 210, an identifier of the low pressure refrigerant 220, and a target concentration (e.g., mass) of one of the first and second refrigerants. Based on the target concentration (e.g., a percentage of the total mass between 0 and 100 percent) of the one of the first and second refrigerants 210 and 220, the charge control module 310 may determine the target concentration for the other one of the first and second refrigerants 210 and 220 (e.g., 100 minus the input target concentration).

The charge control module 310 may receive the user input via one or user input devices of the charging device 204, such as a keyboard, a number pad, one or more buttons, one or more switches, wirelessly from another device, or in another suitable manner. The charge control module 310 opens the output valve 244 (and the control valve 240 if implemented) to charge the refrigeration system 100 and for the pressure sensor 242 to measure the pressure within the refrigeration system 100.

At 404, the charge control module 310 determines whether the output pressure measured by the pressure sensor 242 is greater than the predetermined pressure (e.g., approximately 100 psig or another suitable pressure). If 404 is false, control continues with 408. If 404 is true, control continues with 406. At 408, the charge control module 310 opens the high pressure vapor valve 212, closes the high pressure liquid valve 214, and closes the low pressure liquid valve 224. In this manner, charging of the refrigeration system 100 begins with high pressure refrigerant 210 in vapor form. No charging with the low pressure refrigerant 220 or liquid form of the high pressure refrigerant 210 is performed. Control continues with 418, where the accumulated charge module 300 determines the total present accumulated charge of the refrigeration system 100 as described above. For example, the accumulated charge module 300 may determine a mathematical integral of the mass flowrate measured by the HP flow meter 218 to determine a first mass, a mathematical integral of the mass flowrate measured by the LP flow meter 229 to determine a second mass, and add the first and second masses to the previous value of the accumulated charge (a mass) (e.g., accumulated charge=previous accumulated charge+first mass+second mass).

At 420, the charge control module 310 may determine whether the accumulated charge is less than the total mass to charge the refrigeration system 100 with. If 420 is false, control may continue with 422. If 420 is true, control may return to 404. 422 is discussed further below.

As discussed above, if 404 is true (the pressure measured by the pressure sensor 218 is greater than the predetermined pressure), control continues with 406. At 406, the charge control module 310 may open the high pressure liquid valve 214, close the high pressure vapor valve 212, and open the low pressure liquid valve 224. In this manner, liquid low pressure refrigerant 220 and liquid high pressure refrigerant 210 are input to the refrigeration system 100. No vapor form of the high pressure refrigerant 210 may be input to the refrigeration system 100.

At 410, the charge control module 310 receives the flow rates measured by the flowmeters 218 and 229. At 412, the charge control module 310 determines a target (e.g., volumetric) flowrate for the low pressure refrigerant 220. The charge control module 310 determines the target flowrate for the low pressure refrigerant 220 based on the mass flowrate of the high pressure refrigerant, a predetermined density of the low pressure refrigerant 220, and the target concentration of the low pressure refrigerant 220. For example only, the charge control module 310 may determine the target flowrate for the low pressure refrigerant 220 using the equation:

$$\dot{V}_{LP} = \frac{conc_{lp}\left(\frac{\dot{m}_{hp}}{1 - con_{lp}}\right)}{\rho_{lp}},$$

where $\dot{V}_{LP}$ is a volumetric flow rate of the low pressure refrigerant 220, $conc_{lp}$ is the target concentration of the low pressure refrigerant 220, $\dot{m}_{hp}$ is the mass flowrate of the high pressure refrigerant 210, and $\rho_{lp}$ is the predetermined density of the low pressure refrigerant 220. The predetermined density of the low pressure refrigerant 220 may be, for example, determined by the charge control module 310 based on the indicator of the low pressure refrigerant 220 (e.g., the type of the low pressure refrigerant 220).

At 412, the charge control module 310 may determine a target (e.g., mass) flow rate of the low pressure refrigerant 220. The charge control module 310 determines the target flowrate of the low pressure refrigerant 220 based on the target volumetric flowrate for the low pressure refrigerant 220 and a displacement of the pump 226. The displacement of the pump 226 may be a fixed displacement or a variable displacement. In the example of variable displacement, the pump control module 330 may provide a present displacement of the pump 226. The charge control module 310 may determine the target mass flowrate of the low pressure refrigerant 220 using one or more equations and/or lookup tables that relate target volumetric flowrates and displacements to target mass flowrates.

At 414, the charge control module 310 may determine a target speed of the pump 226 based on achieving the target mass flowrate of the low pressure refrigerant 220. The charge control module 310 may determine the target speed, for example, using a lookup table or an equation that relates target mass flowrates to target speeds.

At 416, the pump control module 330 applies power to the pump 226 and operates the pump 226 at the target speed. Control then continues with 418 and 420 as discussed above.

At 422, when the accumulated charge is greater than or equal to the total mass to charge the refrigeration system 100 with, charging of the refrigeration system 100 with the high pressure refrigerant 210 and the low pressure refrigerant 220 is complete. The pump control module 330 disables the pump 226 and stops the pump 226 from pumping. At 424, the valve control module 320 closes all valves, such as the high pressure vapor valve 212, the high pressure liquid valve 214, the low pressure liquid valve 224, the control valve 240, and the output valve 244. Control may then end.

In various implementations, at 426 at any time during the charging of the refrigeration system 100, in response to the charge control module 310 receiving a stop input via the stop input device 260, control continues with 422 and 424 to stop the pump 226 and close all of the valves.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A charging device comprising:

a first inlet configured to receive a first refrigerant in vapor form;

a second inlet configured to receive the first refrigerant in liquid form;

a third inlet configured to receive a second refrigerant in liquid form, wherein the second refrigerant is a different type of refrigerant than the first refrigerant;

an outlet configured to output the first and second refrigerants to a refrigeration system;

a first valve fluidly connected between the first inlet and the outlet;

a second valve fluidly connected between the second inlet and the outlet;

a third valve fluidly connected between the third inlet and the outlet; and a control module configured to selectively open the first, second, and third valves and charge the refrigeration system with target amounts of the first and second refrigerants, respectively;

a pump fluidly connected between the third valve and the outlet and configured to pump the second refrigerant to the outlet; and an injector configured to receive refrigerant output from the pump.

2. The charging device of claim 1 further comprising a fourth valve fluidly connected between (a) the outlet and (b) the first, second, and third valves.

3. The charging device of claim 2 wherein the control module is configured to further control the fourth valve.

4. The charging device of claim 2 further comprising a fifth valve fluidly connected between (a) the fourth valve and (b) the first, second, and third valves.

5. The charging device of claim 1 wherein the control module is configured to, before opening the second and third valves, open the first valve and output the first refrigerant in vapor form to the refrigeration system.

6. The charging device of claim 5 wherein the control module is configured to open the first valve and output the first refrigerant in vapor form to the refrigeration system until a pressure of refrigerant within the refrigeration system is greater than a predetermined pressure.

7. The charging device of claim 6 wherein the predetermined pressure is at least 75 pounds per square inch gauge.

8. The charging device of claim 6 wherein the control module is configured to, after the pressure of the refrigerant within the refrigeration system is greater than the predetermined pressure, close the first valve and selectively open the second and third valves.

9. The charging device of claim 8 further comprising a pump fluidly connected between the third valve and the outlet and configured to pump the second refrigerant to the outlet, wherein the control module is configured to operate the pump when the third valve is open.

10. The charging device of claim 9 wherein the control module is configured to operate the pump based on a target concentration of the second refrigerant, a predetermined density of the second refrigerant, and a mass flowrate of the first refrigerant.

11. The charging device of claim 1 wherein the first refrigerant includes carbon dioxide.

12. The charging device of claim 1 wherein the second refrigerant includes R1233zd refrigerant.

13. A charging method comprising:

receiving a first refrigerant in vapor form via a first inlet of a charging device;

receiving the first refrigerant in liquid form via a second inlet of the charging device;

receiving a second refrigerant in liquid form via a third inlet of the charging device, wherein the second refrigerant is a different type of refrigerant than the first refrigerant;

outputting the first and second refrigerants from an outlet of the charging device to a refrigeration system; and selectively opening first, second, and third valves and charging the refrigeration system with target amounts of the first and second refrigerants, respectively, wherein:

the first valve is fluidly connected between the first inlet and the outlet;

the second valve is fluidly connected between the second inlet and the outlet;

the third valve is fluidly connected between the third inlet and the outlet;

selectively opening the first, second and third valves includes, before opening the second and third valves, opening the first valve and outputting the first refrigerant in vapor form to the refrigeration system; and selectively opening the first, second, and third valves includes, after a pressure of the refrigerant within the refrigeration system is greater than a predetermined pressure, closing the first valve and selectively opening the second and third valves.

14. The charging method of claim 13 further comprising, by a pump of the charging device fluidly connected between the third valve and the outlet, pumping the second refrigerant to the outlet.

15. The charging method of claim 13 further comprising selectively opening a fourth valve of the charging device, wherein the fourth valve is fluidly connected between (a) the outlet and (b) the first, second, and third valves.

16. The charging method of claim 15 further comprising selectively opening a fifth valve of the charging device, wherein the fifth valve is fluidly connected between (a) the fourth valve and (b) the first, second, and third valves.

17. A charging device comprising:

a first inlet configured to receive a first refrigerant in vapor form;

a second inlet configured to receive the first refrigerant in liquid form;

a third inlet configured to receive a second refrigerant in liquid form, wherein the second refrigerant is a different type of refrigerant than the first refrigerant;

an outlet configured to output the first and second refrigerants to a refrigeration system;

a first valve fluidly connected between the first inlet and the outlet;

a second valve fluidly connected between the second inlet and the outlet;

a third valve fluidly connected between the third inlet and the outlet;

a control module configured to selectively open the first, second, and third valves and charge the refrigeration system with target amounts of the first and second refrigerants, respectively, wherein the control module is configured to, before opening the second and third valves, open the first valve and output the first refrigerant in vapor form to the refrigeration system, wherein the control module is configured to open the first valve and output the first refrigerant in vapor form to the refrigeration system until a pressure of refrigerant within the refrigeration system is greater than a predetermined pressure, wherein the control module is configured to, after the pressure of the refrigerant within the refrigeration system is greater than the predetermined pressure, close the first valve and selectively open the second and third valves; and a pump fluidly connected between the third valve and the outlet and configured to pump the second refrigerant to the outlet, wherein the control module is configured to operate the pump when the third valve is open, and wherein the control module is configured to operate the pump based on a target concentration of the second refrigerant, a predetermined density of the second refrigerant, and a mass flowrate of the first refrigerant.

* * * * *